United States Patent [19]

Manabe et al.

[11] 4,322,214

[45] Mar. 30, 1982

[54] DYEING METHOD

[75] Inventors: Osamu Manabe, Osaka; Masayasu Utsunomiya, Ashiya; Morihiro Kamiyama, Ibaragi; Michiaki Tsutsui; Masayuki Matsumoto, both of Osaka, all of Japan

[73] Assignee: Asahi Chemical Company Limited, Osaka, Japan

[21] Appl. No.: 138,265

[22] Filed: Apr. 9, 1980

[30] Foreign Application Priority Data

Apr. 18, 1979 [JP] Japan ..... 54/48171
May 25, 1979 [JP] Japan ..... 54/65313

[51] Int. Cl.[3] ..... C09B 49/00; D06P 1/30

[52] U.S. Cl. ..... 8/582; 8/585; 8/587; 8/618; 8/652; 8/918

[58] Field of Search ..... 8/582, 585, 587, 591, 8/652

[56] References Cited

U.S. PATENT DOCUMENTS

| | | | |
|---|---|---|---|
| 1,989,784 | 2/1935 | Berthold et al. | 8/568 |
| 2,174,486 | 9/1939 | Chambers et al. | 8/571 |
| 4,252,533 | 2/1981 | Heid et al. | 8/587 |

FOREIGN PATENT DOCUMENTS

| | | |
|---|---|---|
| 16933 | 10/1980 | European Pat. Off. . |
| 604468 | 10/1934 | Fed. Rep. of Germany . |
| 743566 | 11/1943 | Fed. Rep. of Germany . |
| 1393050 | 3/1965 | France . |

*Primary Examiner*—A. Lionel Clingman
*Attorney, Agent, or Firm*—Toren, McGeady & Stanger

[57] ABSTRACT

Textile materials such as fiber and cloth can be dyed more satisfactorily with sulfur dyes or sulfurized vat dyes by allowing an organic mercapto compound and/or an organic sulfur compound capable of generating mercapto groups under dyeing conditions to be present in dye baths. Still more improved dyeing results may be obtained by allowing a sulfite salt compound to be further present in such dye baths.

9 Claims, No Drawings

DYEING METHOD

BACKGROUND OF THE ART

1. Field of the Invention

This invention relates to a dyeing method employing sulfur dyes or sulfurized vat dyes.

2. Brief Description of the Prior Art

There is known a method of dyeing textile substrates with a sulfur dye or sulfurized vat dye in which an alkaline reducing agent is employed. The method comprises reducing a sulfur dye or sulfurized vat dye with an alkaline reducing agent to obtain a compound (leuco compound) which is readily adsorbed on a textile substrate, immersing a textile substrate in a dye bath containing the leuco compound as dissolved therein and oxidizing the leuco compound in situ, i.e. as adsorbed on the textile substrate, to a water-insoluble sulfur dye or sulfurized vat dye. Among examples of said alkaline reducing agent, there are sodium sulfide, sodium hydrogen sulfide, sodium hydrosulfite-alkali, sodium formaldehyde sulfoxylate-alkali, glucose-alkali, molasses-alkali, thiourea dioxide-alkali and so forth. However, any dyeing procedure using such an alkaline reducing agent has several disadvantages. For example, when the alkaline reducing agent is sodium sulfide or sodium hydrogen sulfide (hereinafter referred to as reducing agent A), the following drawbacks are inevitable. (1) The dye bath containing the reduced dyestuff is readily oxidized by atmospheric oxygen to yield a water-insoluble dyestuff on the bath surface and this dyestuff tends to be deposited on the textile substrate to interfere with level dyeing. (2) Treating the residual or exhausted bath liquor liberates a poisonous gas, i.e. hydrogen sulfide, thus presenting a pollution problem. When the alkaline reducing agent is any of sodium dithionite-alkali, sodium formaldehyde sulfoxylate-alkali, glucose-alkali, molasses-alkali and thiourea dioxide-alkali (hereinafter referred to as reducing agent B), the following drawbacks are encountered. (3) Depending on the dyestuff used, especially in the case of a black dye, it cannot be successfully reduced to the leuco form and, therefore, this method can be utilized only with a dye selected from a limited group of dyes. (4) Even with such dyes, uneven dyeing takes place in many instances, although this disadvantage is somewhat less pronounced than with reducing agent A. Furthermore, irrespective of whether reducing agent A or reducing agent B is employed, the probability of adsorption on textile substrates (dyeing efficiency) is low for certain dyes and in order that the textile substrates are to be dyed deep shades, there must be prepared dye baths containing large amounts of dyestuffs. Of course, this is an uneconomical proposition. By way of illustration, when reducing agents A are employed, dyeing efficiency is low for blue dyes, while reducing agents B provide for only inadequate dyeing efficiency when the dyestuffs belong to the categories of yellow, orange and black.

OBJECTS AND SUMMARY OF THE INVENTION

It is an object of this invention to provide a dyeing method which is practicable with whichever of a sulfur dye and a sulfurized vat dye.

It is another object of this invention to provide a dyeing method which is high in dyeing efficiency and conductive to level dyeing over the entire spectrum of sulfur dyes and sulfurized vat dyes.

It is still another object of this invention to provide a dyeing method employing a sulfur dye or sulfurized vat dye, wherein an after-treatment of the residual dye bath liguor does not cause an evolution of hydrogen sulfide gas.

The above and other objects of this invention will become apparent from the following detailed description of the invention proceeds.

DETAILED DESCRIPTION OF THE INVENTION

This invention relates to a method of dyeing a textile substrate in an alkaline dye bath containing a sulfur dye or sulfurized vat dye, characterized in that said dye bath contains as added an organic mercapto compound having at least one —$SM_1$ group ($M_1$ is a hydrogen atom or alkali metal atom) and/or an organic sulfur compound capable of generating mercapto groups under dyeing conditions.

In another aspect, this invention relates to a method of dyeing a textile substrate in a dye bath containing a sulfur dye or sulfurized vat dye, characterized in that said dye bath contains as added said organic mercapto compound and/or mercapto-generating organic sulfur compound (both of the compounds will sometimes be referred to generally as organic mercapto compound) and a sulfite salt.

In accordance with this invention, a dye bath containing the above-mentioned organic mercapto compound alone or the same compound together with a sulfite salt is employed. By means of the compound or compounds mentioned above, any of the commercially available sulfur dyes and sulfurized vat dyes can be successfully transformed into leuco forms. That is to say, by the method of this invention, textile substrates can be dyed with any of the available sulfur dyes and sulfurized vat dyes. Furthermore, in accordance with this invention, the dye bath need not be a fresh bath. Thus, even if the dye bath containing such a dyestuff as dissolved therein is allowed to stand, it is less liable to be oxidized because the dye is present in the environment which does not easily allow the dye to be oxidized. Thus, the formation of a water-insoluble oxide film (a film of oxidized dye) is virtually prevented and, hence, there is a minimum possibility of unlevel dyeing. What is worthy of note in this regard is that despite the fact that such a leuco form is hardly oxidized when present as dissolved in the dye bath medium, it does not require any extraordianrily intense oxidizing conditions to oxidize the leuco compound already adsorbed on the textile substrate but the leuco compound can be easily converted to the water-insoluble dye under the same oxidizing conditions as those heretofore employed. Furthermore, the dyeing method of this invention provides satisfactory dyeing efficiencies with all sulfur dyes and sulfurized vat dyes and, therefore, allows textile substrates to be dyed deep shades with a minimum of dye. This is a remarkable economic advantage. The method of this invention is also free from pollution problems, for an after-treatment of the residual dye bath liquor does not give rise to hydrogen sulfide gas which is a toxic substance. In addition, the light fastness and laundering resistance of the textile products dyed by the method of this invention are at least equal or even superior to those of the products dyed by the conventional dyeing processes.

As far as dyeing of textile materials with sulfur dyes is concerned, the use of C.I. Sulfur Black-1 accounts for more than a half of production but this dyestuff has the disadvantage that textile materials are severely enfeebled. The dyeing method according to this invention has an additional advantage that this tendency of strength reduction is substantially improved.

The dye bath to be used in the method of this invention is an alkaline bath in which an organic mercapto compound is present alone or in combination with a sulfite salt.

The alkali to be used to make the dye bath of the invention alkaline may be any of such conventional agents as alkali metal hydroxides (e.g. sodium hydroxide, potassium hydroxide), alkaline earth metal hydroxides (e.g. magnesium hydroxide), alkali metal carbonates (e.g. sodium carbonate, potassium carbonate), alkali matal hydrogen carbonates (e.g. sodium hydrogen carbonate, potassium hydrogen carbonate), alkali metal phosphates (e.g. trisodium phosphate, tripotassium phosphate, disodium hydrogen phosphate, dipotassium hydrogen phosphate), ammonium hydroxide, ammonium salts (e.g. ammonium carbonate), other inorganic bases, mono-, di- and tri-lower alkyl-amines (e.g. trimethylamine, diethylamine, monopropylamine), ethylene- and polyethylene-polyamines (e.g. ethylenediamine, diethylenetriamine) and alkanolamines (e.g. monoethanolamine, diethanolamine). Preferred are alkali metal hydroxides, carbonates, hydrogen carbonates and phosphates.

The organic mercapto compound having at least one $—SM_1$ group, to be used according to the invention, includes a great variety of known compounds such as those represented by the general formula $$A—SM_1 \quad (1)$$

wherein $M_1$ is a hydrogen atom or an alkali metal atom and A is a straight or branched alkyl group containing 1 to 8 carbon atoms (said alkyl group may have such a substituent as hydroxyl, sulfo, carboxyl or phosphono ($—PO_3H$) and said substituent may take the form of an alkali metal salt), the group $M_2(CH_2)_aSCH_2CH(OH)CH_2$—($M_2$: H, COOH, $SO_3H$ or $PO_3H$; a: 1 or 2), the group $CH_3CH_2NH(CH_2)_2$—, the group $HO(CH_2)_2OCH_2CH(OH)CH_2$—, the group $HOCH_2CH(OH)CH_2OCH_2CH(OH)CH_2$—, the group

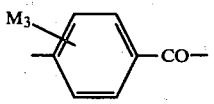

($M_3$: H, $NH_2$, $OM_1$ or $SO_3M_1$, $M_1$ having the same meaning as above), the group

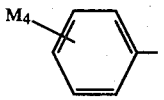

($M_4$: H, $NH_2$, $OM_1$, $SO_3M_1$ or $COOM_1$, $M_1$ having the same meaning as above), the group

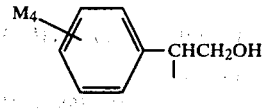

($M_4$ having the same meaning as above), the group

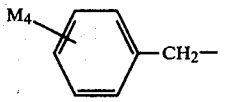

($M_4$ having the same meaning as above), the group

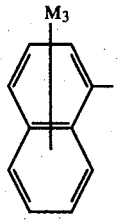

($M_3$ having the same meaning as above), the group

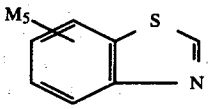

($M_5$: H, $SO_3M_1$ or $COOM_1$, $M_1$ having the same meaning as above) or the group

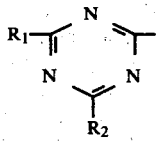

wherein $R_1$ and $R_2$ are the same or different and each is a chlorine atom, a hydroxyl group, $M_6(CH_2)_bNH$—($M_6$: H or OH; b: integer of 1 to 4) or

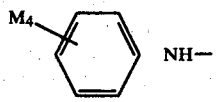

($M_4$ having the same meaning as above), those represented by the general formula $$M_1S—B—SM_1 \quad (2)$$

wherein —B— is the group $—(CH_2)_c—$ (c: integer of 1 to 8), the group $—CH_2CH(OH)CH_2OCH_2CH(OH)CH_2OCH_2CH(OH)CH_2$—, the group $—CH_2CH(OH)CH_2NH(CH_2)_2NHCH_2CH(OH)CH_2$— the group $—CH_2CH(OH)CH_2O(CH_2)_2OCH_2CH(OH)CH_2$— the group $—(CH_2)_2O(CH_2)_2O(CH_2)_2$—, the group $—CH_2CH(OH)CH_2$—, the group

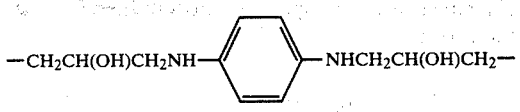

the group

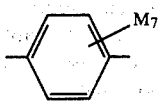

($M_7$: $SO_3M_1$ or $COOM_1$, $M_1$ having the same meaning as above), the group

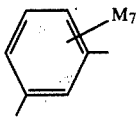

($M_7$: as above), the group

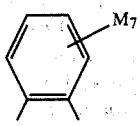

($M_7$: as above), the group

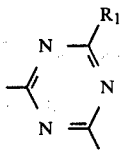

($R_1$: as above), the group

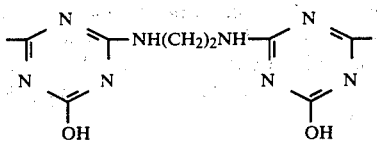

the group

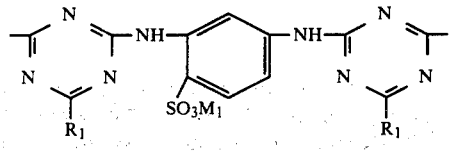

($M_1$ and $R_1$ each having the same meaning as above) or the group

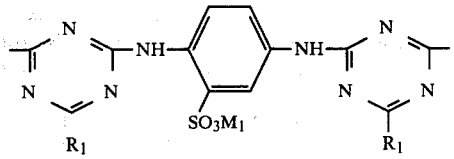

($M_1$ and $R_1$ each having the same meaning as above), those represented by the general formula

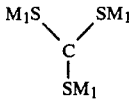

(3)

wherein

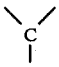

is the group

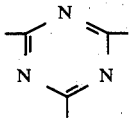

or the group

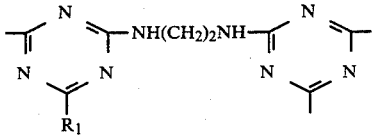

($R_1$ having the same meaning as above) and $M_1$ has the same meaning as above and those represented by the general formula

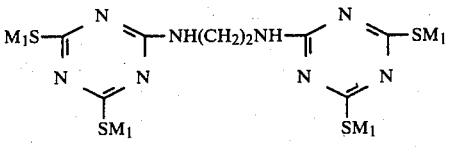

(4)

wherein $M_1$ has the same meaning as above.

Examples of the compounds represented by the above general formula (1) wherein A is a substituted or unsubstituted, straight or branched alkyl group containing 1 to 8 carbon atoms are ethyl mercaptan, sodium methyl mercaptide, 2-mercaptoethanesulfonic acid and sodium and potassium salts thereof, 2-mercaptoethanol, 3-mercaptopropionic acid and sodium and potassium salts thereof, 2-mercaptoethanephosphonic acid and sodium and potassium salts thereof, sodium methyl mercaptide, potassium methyl mercaptide, thioglycolic acid and sodium and potassium salts thereof, n-propylmercaptan, sodium n-propyl mercaptide, 3-mercapto-1,2-dihydroxypropane and sodium and potassium salts thereof, 3-mercaptopropanesulfonic acid and sodium and potassium salts thereof, 3-mercaptophosphonic acid and sodium and potassium salts thereof, 3-mercapto-2-hydroxypropanesulfonic acid and sodium and potassium salts thereof, 2-ethylhexyl thiol, 2-hydroxy-1-mercaptopropane and sodium and potassium salts thereof, 6-mercapto-5-ethylhexanesulfonic acid and sodium and potassium salts thereof.

The compound of formula (1) wherein A is the group $M_2(CH_2)_aSCH_2CH(OH)CH_2$— is, for example, 3-ethylthio-2-hydroxypropane-1-thiol, 2-(3-mercapto-2-hydroxypropylthio)-acetic acid, 2-(3-mercapto-2-hydroxypropylthio) ethane-1-sulfonic acid or 1-(3-mercapto-2-hydroxypropylthio)methane-phosphonic acid.

The compound of formula (1) wherein A is the group

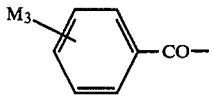

includes, among others, thio-benzoic acid and sodium and potassium salts thereof, 2-aminothiobenzoic acid and sodium and potassium salts thereof, 3-amino-thiobenzoic acid and sodium and potassium salts thereof, 4-amino-thiobenzoic acid and sodium and potassium salts thereof, 2-hydroxy-thiobenzoic acid and sodium and potassium salts thereof, 3-hydroxy-thiobenzoic acid and sodium and potassium salts thereof, 4-hydroxy-thiobenzoic acid and sodium and potassium salts thereof, 2-sulfo-thiobenzoic acid and sodium and potassium salts thereof, 3-sulfo-thiobenzoic acid and sodium and potassium salts thereof, 4-sulfo-thiobenzoic acid and sodium and potassium salts thereof.

As the compound of formula (1) wherein A is the group

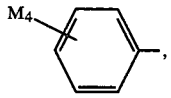

mention may be made of thiophenol, sodium thiophenolate, 4-mercaptobenzenesulfonic acid and sodium and potassium salts thereof, 3-mercaptobenzenesulfonic acid and sodium and potassium salts thereof, 2-mercaptobenzoic acid and sodium and potassium salts thereof, 4-amino thiophenol and sodium and potassium salts thereof, 3-amino-thiophenol and sodium and potassium salts thereof, 2-amino-thiophenol and sodium and potassium salts thereof, 4-hydroxy-thiophenol and sodium and potassium salts thereof, 3-hydroxy-thiophenol and sodium and potassium salts thereof, and so on.

Examples of the compound of formula (1) wherein A is the group

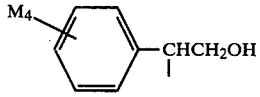

are β-hydroxy-α-mercaptoethylbenzene and sodium and potassium salts thereof, 4-amino-(β-hydroxy-α-mercapto)ethylbenzene and sodium and potassium salts thereof, 4,β-dihydroxy-α-mercapto-ethylbenzene and sodium and potassium salts thereof, β-hydroxy-α-mercaptoethylbenzene-4-sulfonic acid and sodium and potassium salts thereof, β-hydroxy-α-mercapto-ethyl-benzene-3-carboxylic acid and sodium and potassium salts thereof.

Examples of the compound of formula (1) wherein A is the group

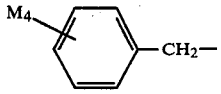

are benzyl mercaptan and sodium and potassium salts thereof, 4-hydroxybenzyl mercaptan and sodium and potassium salts thereof, 3-sulfobenzyl mercaptan and sodium and potassium salts thereof, 4-carboxybenzyl mercaptan and sodium and potassium salts thereof.

Examples of the compound of formula (1) wherein A is the group

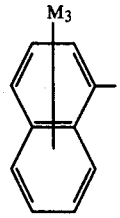

are naphthyl mercaptan and sodium and potassium salts thereof, 4-sulfo-naphthyl mercaptan and sodium and potassium salts thereof, 6-sulfo-naphthyl mercaptan and sodium and potassium salts thereof, 7-sulfo-naphthyl mercaptan and sodium and potassium salts thereof, 5-amino-naphthyl mecaptan and sodium and potassium salts thereof, 8-amino-naphthyl mercaptan and sodium and potassium salts thereof.

Examples of the compound of formula (1) wherein A is the group

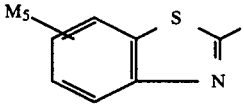

are 2-mercaptobenzothiazole and sodium and potassium salts thereof, 6-carboxy-2-mercaptobenzothiazole and sodium and potassium salts thereof, 5-carboxy-2-mercaptobenzothiazole and sodium and potassium salts thereof, 6-sulfo-20mercaptobenzothiazole and sodium and potassium salts thereof, 5-sulfo-2-mercaptobenzothiazole and sodium and potassium salts thereof.

Examples of the compound of formula (1) wherein A is the group

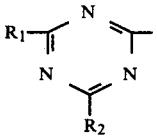

are 2-chloro-4-hydroxy-6-mercapto-1,3,5-triazine and sodium and potassium salts thereof, 2,4-dichloro-6-mercapto-1,3,5-triazine and sodium and potassium salts thereof, 2,4-dihydroxy-6-mercapto-1,3,5-triazine and sodium and potassium salts thereof, 2-(β-hydroxyethylamino)-4-hydroxy-6-mercapto-1,3,5-triazine and sodium and potassium salts thereof, 2,4-dianilino-6-mercapto-1,3,5-triazine and sodium and potassium salts thereof, 2-anilino-4-hydroxy-6-mercapto-1,3,5-triazine and sodium and potassium salts thereof, 2-(3'-sulfoanilino)-4-hydroxy-6-mercapto-1,3,5-triazine and sodium and potassium salts thereof, 2-(4'-sulfo-anilino)-4-hydroxy-6-mercapto-1,3,5-triazine and sodium and potassium salts thereof.

Other compounds represented by general formula (1) are, for example, 3-ethylthio-1-mercapto-2-propanol, S-(3-mercapto-2-hydroxypropyl)thioglycolic acid, S-(3-mercapto-2-hydroxypropyl)thiomethanephosphonic acid, S-(3-mercapto-2-hydroxypropyl)-2-thioethane-1-sulfonic acid, 2-(ethylamino)ethanethiol, 3-(2-hydroxyethoxy)-1-mercapto-2-propanol and 3-(2,3-dihydroxypropoxy)-2-hydroxy-propanethiol as well as sodium and potassium salts of these.

Especially preferred among the compounds of general formula (1) are sodium 2-mecaptoethanesulfonate, thioglycolic acid and sodium and potassium salts thereof, 2-mercaptoethanephosphonic acid and sodium salt thereof, 2-mercaptopropionic acid and sodium and potassium salts thereof, 3-mercapto-2-hydroxypropanesulfonic acid and sodium and potassium salts thereof, 4-sulfothiobenzoic acid and sodium and potassium salts thereof, 2-mercaptobenzoic acid and sodium salt thereof, 4-mercaptobenzene-sulfonic acid and sodium salt thereof, 2,4-dihydroxy-6-mercapto-1,3,5-triazine and sodium salt thereof, sodium benzyl mercaptide, 2-mercaptoethanol, 3-mercapto-1,2-dihydroxypropane, etc.

The compound of the above general formula (2) wherein —B— is the group $-(CH_2)_c-$ includes, among others, 1,2-ethanedithiol, 1,3-propanedithiol, 1,4-butanedithiol, 1,5-pentanedithiol, 1,6-hexanedithiol, 1,7-heptanedithiol, 1,8-octanedithiol and sodium and potassium salts of these.

Examples of the compound of formula (2) wherein —B— is the group

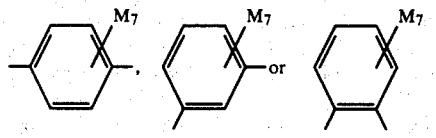

are 1,4-benzenedithiol, 2,5-dimercaptobenzenesulfonic acid, 1,3-benzenedithiol, 2,4-mercaptobenzenesulfonic acid, 1,2-benzenedithiol, 2,3-dimercaptobenzenesulfonic acid, and sodium and potassium salts of these.

Examples of the compound of formula (2) wherein —B— is the group

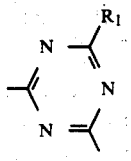

are 2-hydroxy-4,6-dimercapto-1,3,5-triazine, 2-(β-hydroxyethylamino)-4,6-dimercapto-1,3,5-triazine, 2-(3'-sulfoanilino)-4,6-dimercapto-1,3,5-triazine, and sodium and potassium salts of these.

Other compounds represented by general formula (2) are, for example, 1,3-bis(2'hydroxy-3'-mercaptopropoxy)-2-propanol, 1,2-bis(2'-hydroxy-3'-mercaptopropoxy)ethane, 1,4-bis(2'-hydroxy-3'-mercaptopropylamino)-benzene, 1,2-bis(2'-hydroxy-3'-mercaptopropylamino)ethane, 1,2-bis(4'-hydroxy-6'-mercapto-1',3',5'-triazinyl-2'-amino)ethane, 1,2-bis(2'-mercaptoethoxy)-ethane, 1,4-bis(4'-chloro-6'-mercapto-1',3',5'-triazinyl-2'-amino)benzene-2-sulfonic acid, 1,4-bis(4'-hydroxy-6'-mercapto-1',3',5'-triazinyl-2'-amino)benzene-2-sulfonic acid, 1-(4'-p-sulfoanilino-6'-mercapto-1',3',5'-triazinyl-2'-amino)-4-(4''-hydroxy-6''-mercapto-1'', 3'',5''-triazinyl-2''-amino)benzenesulfonic acid, 2,4-bis(4'-ethylamino-6'-mercapto-1',3',5'-triazinyl-2'-amino)-benzene-1-sulfonic acid, 1,3-dimercapto-2-propanol, and sodium and potassium salts of these.

Particularly preferred among the compounds represented by general formula (2) are sodium 2,5-dimercapto-benzene-1-sulfonate, 1,3-bis(2'-hydroxy-3'-mercaptopropoxy)-2-propanol, 1,2-bis(2'-hydroxy-3'-mercaptopropoxy)ethane, 1,2-bis(2'-hydroxy-3'-mercaptopropylamino)ethane, 1,2-bis(4'-hydroxy-6'-mercapto-1',3',5'-triazinyl-2'-amino)ethane, 1,2-bis(2'-mercaptoethoxy)ethane, 1,3-dimercapto-2-propanol, etc.

The compound of general formula (3) includes, among others, 2,4,6-trimercapto-1,3,5-triazine, 1-(4'-hydroxy-6'-mercapto-1',3',5'-triazinyl-2'-amino)-2-)4'',6''-dimercapto-1'',3'',5''-triazinyl-2''-amino)ethane, and sodium and potassium salts of these. Preferred is trisodium salt of 2,4,6-trimercapto-1,3,5-triazine.

The compound of general formula (4) includes 1,2-bis(4',6'-dimercapto-1,3,5-triazinyl-2'-amino)ethane and sodium and potassium salts thereof.

As the organic sulfur compound capable of generating a mercapto group or mercapto groups under dyeing conditions, there may be used a wide variety of known compounds such as the compounds represented by the general formula

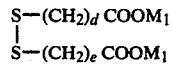

(5)

wherein d is 1 or 2, e is 1 or 2 and $M_1$ has the same meaning as above, the compounds represented by the general formula

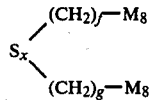

(6)

wherein $-(CH_2)_f-$ and $-(CH_2)_g-$ are the same or different and each is $-CH_2-$, $-(CH_2)_2-$, $-(CH_2)_3-$, $-(CH_2)_4-$, $-CH_2CH(OH)CH_2-$. $-(CH_2)_2CH(OH)CH_2-$, $-CH_2CH(OH)(CH_2)_2-$ or $-CH_2CH(OH)CH(OH)CH_2-$, x is an integer of 2 to 4 and $M_8$ is a hydrogen or chlorine atom, $-OM_1$, $-SO_3M_1$ or $-SM_1$, $M_1$ having the same meaning as above, the compounds represented by the general formula

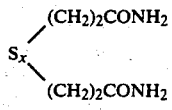

(7)

wherein x has the same meaning as above, the compounds represented by the general formula

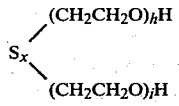

(8)

wherein h is 2 or 3, i is 2 or 3 and x has the same meaning as above, the compounds represented by the general formula

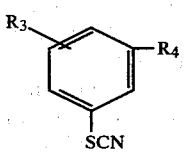

(9)

wherein $R_3$ is $—CH_3$ or $SO_3M_1$ ($M_1$ having the same meaning as above) and $R_4$ is a hydrogen atom or —SCN, the compounds represented by the general formula

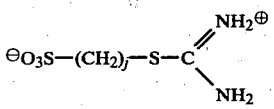

(10)

wherein $—(CH_2)_j—$ is $—(CH_2)_2—$, $—(CH_2)_3—$ or $—CH_2CH(OH)CH_2—$, the compound represented by the formula

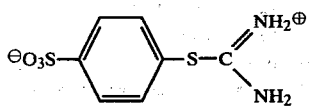

(11)

the compound represented by the formula

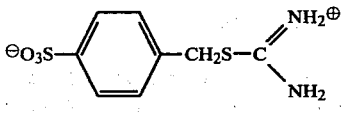

(12)

the compounds represented by the general formula

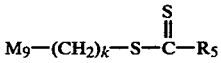

(13)

wherein $R_5$ is an alkyl group containing 1 to 4 carbon atoms, k is an integer of 1 to 3, and $M_9$ is $SO_3M_1$ or $COOM_1$, $M_1$ having the same meaning as above, and the compounds represented by the general formula

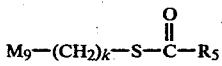

(14)

wherein $R_5$, k and $M_9$ are as above defined.

Examples of the compound of general formula (5) are dithiodiglycolic acid, dithiodipropionic acid and sodium and potassium salts of these. Examples of the compound of general formula (6) are dithiodimethanol, dithiodiethanol, bis(3-hydroxy-n-propyl) disulfide, bis(2-hydroxy-n-propyl) disulfide, trithiodiethanol, tetrathiodiethanol, 1,3-bis(3-hydroxy-n-propyl) trisulfide, dithiodiethylsulfonic acid and sodium and potassium salts thereof, bis(2-mercaptoethyl) disulfide, dithiodiethylsulfonic acid, dithiodipropylsulfonic acid and sodium and potassium salts thereof, bis(2-chloroethyl) disulfide, bis(2,3-dihydroxypropyl) disulfide, bis(3,4-dihydroxy-n-butyl) disulfide, bis(3-chloro-2-hydroxypropyl) disulfide, bis(3-sulfo-2-hydroxypropyl) disulfide and sodium and potassium salts thereof. Examples of the compound of general formula (7) are dithiodiethylcarboxamide, 1,3-bis(2'-carbamoyl-ethyl) trisulfide, and 1,4-bis(2'-carbamoylethyl) tetrasulfide. Examples of the compound of general formula (8) are bis[2-(2-hydroxyethoxy)ethyl] disulfide, bis[2-[2-(2-hydroxyethoxy)ethoxy]ethyl] disulfide, bis[2-(2-hydroxyethoxy)ethyl] trisulfide, and bis[2-[2-(2-hydroxyethoxy)ethoxy]ethyl] trisulfide. Examples of the compound of general formula (9) are 4-sulfobenzeneisothiocyanate and sodium and potassium salts thereof, 4-methylbenzeneisothiocyanate, 4-sulfo-1,3-phenylenediisothiocyanate and sodium and potassium salts thereof and 4-methyl-1,3-phenylenediisothiocyanate. Examples of compound of general formula (10) are S-(2-sulfoethyl)-thiuronium, S-(3-sulfopropyl)thiuronium, S-(2-hydroxy-3-sulfopropyl)thiuronium, and sodium and potassium salts of these. The compound of formula (11) includes S-(4'-sulfophenyl)thiuronium and sodium and potassium salts thereof. The compound of formula (12) includes S-(4'-sulfobenzyl)thiuronium and sodium and potassium salts thereof. Examples of the compound of general formula (13) are methylxanthogenacetic acid, ethylxanthogenacetic acid, n-butylxanthogenpropionic acid, ethylxanthogenethanesulfonic acid, n-propylxanthogenpropanesulfonic acid, and sodium and potassium salts of these. Examples of the compound of general formula (14) are acetylthioacetic acid, acetylthiopropionic acid, 2-acetylthio-ethanesulfonic acid, 2-acetylthio-propanesulfonic acid, and sodium and potassium salts of these. Especially preferred among these organic sulfur compounds are dithiodiglycolic acid and sodium and potassium salts thereof, S-(2-sulfo-ethyl)thiuronium, methylxanthogenacetic acid, ethylxanthogenacetic acid, sodium acetylthioacetate, sodium 2-acetylthioethanesulfonate, S-(4'-sulfobenzyl)thiuronium, dithiodiethylcarboxamide, bis(3-chloro-2-hydroxypropyl) disulfide, bis(3-sulfo-2-hydroxypropyl) disulfide, dithiodiethanol, bis(2-mercaptoethyl) disulfide, bis[2-(2-hydroxyethoxy) ethyl]disulfide and so on.

In the practice of the present invention, the above-mentioned organic mercapto compound and organic sulfur compound may be used either alone or in combination. When the organic sulfur compound is used, a procedure for mercapto group formation in the dye bath should be carried out before or during the dyeing process. Since, according to the present invention, the dye bath contains an alkali, the mercapto group formation can easily be attained through the action of the alkali when the dye bath is heated, for instance, to a temperature of about 30° C. or above.

The above-mentioned organic mercapto compound or precursor thereof is used in the dye bath generally at a concentration of about 1 to 100 grams per liter, preferably about 2 to 50 grams per liter of dye bath. When a sulfite salt is combinedly used, the organic mercapto compound or precursor thereof is used generally at a concentration of about 0.1 to 20 grams per liter, preferably about 0.2 to 5 grams per liter of dye bath. The reason for the reduction in the amount of the organic mercapto compound or precursor thereof as caused by the combined use of a sulfite salt is that the organic mercaptan reduces the dye to convert it to a leuco form and at the same time is oxidized to yield a disulfide compound, which, however, is reduced back to the mercapto compound by the sulfite salt. Too low a concentration of the organic mercapto compound in the dye bath tends to fail to achieve the effect of the invention. Excessively high concentrations of the organic mercapto compound in the dye bath does not improve the effect any further and therefore are uneconomical. The organic mercapto compound is generally used in the form of an aqueous solution or dispersion, and the use thereof in the form of an aqueous solution is preferred. Those organic mercapto compounds that have strongly acidic or hydrophilic substituent groups such as carboxyl, sulfo, phosphono, hydroxyl and amino are soluble in water and therefore do not require any procedure for making aqueous solutions thereof. On the other hand, those organic mercapto compound that have no such substituents, being insoluble or only sparingly soluble in water, should preferably be used in the form of aqueous solutions or dispersions with the addition of small amounts of polar solvents and/or emulsifiers. Usable polar solvents are, for example, lower alkanols such as methanol, ethanol and isopropyl alcohol, acetone, ethanolamine and other hydrophilic organic solvents, and usable emulsifiers are, for instance, nonionic surfactants such as polyoxyethylene alkyl ethers and anionic surfactants such as dodecylbenzenesulfonate.

The sulfite salt to be used in the present invention includes sulfites and acid sulfites. A wide variety of known sulfites can be used, such as sodium sulfite, potassium sulfite, ammonium sulfite, magnesium sulfite, iron sulfite, copper sulfite, nickel sulfite, zinc sulfite, cobalt sulfite and manganese sulfite. Also, a wide variety of acid sulfites can be used, such as sodium hydrogen sulfite, potassium hydrogen sulfite, ammonium hydrogen sulfite, magnesium hydrogen sulfite, iron hydrogen sulfite, copper hydrogen sulfite, nickel hydrogen sulfite, zinc hydrogen sulfite, cobalt hydrogen sulfite and manganese hydrogen sulfite. When such an acid sulfite is used, it is converted into a normal salt by reaction with the alkali in the dye bath. In the practice of the invention, sodium sulfite, potassium sulfite, sodium hydrogen sulfite and potassium hydrogen sulfite are preferably used as the sulfite salts.

The above-mentioned sulfite salt is added to the dye bath generally at a concentration of about 0.1 to 200 grams per liter, preferably at a concentration of about 1 to 100 grams per liter.

The level of addition of the previously mentioned alkali depends upon the kind of the dye to be used. Generally, the amount of the alkali should preferably be such that the pH of the dye bath be optimal to the dye to be used. For example, in the case of C.I. Sulfur Green 3 which shows better dyeing property in the pH range of 7 to 11 out of the pH range of 7 to 14, the amount of the alkali should preferably be adjusted so that the dye bath may have a pH of about 7 to 11. In the case of C.I. Sulfur Brown 52 which presents better dyeing property in the pH range of 12 to 14 out of the pH range of 7 to 14, the alkali should preferably be added to the extent that the dye bath has a pH of about 12 to 14.

The method of the present invention can be applied to any of the sulfur dyes and sulfurized vat dyes currently on the market. The concentration of the dye in the dye bath is generally about 0.05 to 20% (owf, of weight of fiber).

The textile materials to which the method of the present invention can be applied include those that have been dyed with sulfur dyes and sulfurized vat dyes by the conventional methods, such as, for example, cellulosic fibers (e.g. cotton, viscose rayon, hemp), polyamide fibers, polyvinyl alcohol fibers, and blended yarns and union cloths made of these. These textile materials may be in any fiber aggregate, yarn-like and cloth-like forms.

In the practice of the invention, the above-mentioned alkali, organic mercapto compound, sulfite salt and dye are added, together with water, to the dye bath, and then the mixture is heated at about 50° to 90° C. for about 5 to 10 minutes, to cause dissolution and conversion of the dye into a leuco form. In doing so, modifications may be made. Thus, for example, the dye bath may be prepared by thoroughly kneading the dye, alkali and organic mercapto compound by the use of hot water, then adding the sulfite salt to cause complete dissolution of the dye and finally adding a further amount of warm water, or by preliminarily dissolving the alkali, organic mercapto compound and sulfite salt in warm water and then adding the dye, or by simultaneously adding the alkali, organic mercapto compound, sulfite salt and dye to warm water. Thereafter, a textile material is immersed in the dye bath so prepared and the bath is heated to and at a temperature between room temperature and 200° C., preferably in the range of 60° to 100° C., to cause adsorption of the leuco compound on the textile material. The time during which the material should be kept immersed depends upon the dyeing machine used. Generally, however, about several seconds to 60 minutes is adequate.

In oxidizing the leuco compound as adsorbed on the textile material, the conventional methods and conditions are all applicable. Thus, for example, the textile material treated by the above procedure is immersed and treated in a bath containing an oxidizing agent, such as hydrogen peroxide-acetic acid, sodium dichromate-acetic acid, potassium iodate-acetic acid or ammonium persulfate, at a concentration of 1 to 20 grams per liter, at a temperature between room temperature and 80° C. for several seconds to about 30 minutes.

The following examples will illustrate the invention more detailedly. In the examples, "%" means, unless otherwise stated, "percent by weight".

EXAMPLE 1

0.3 Grams of Asathio Blue-BB [a trademark of Asahi Chemical Co., Ltd., C.I. Sulfur Blue-7], 5 ml of a 10% aqueous solution of sodium thioglycolate and 2.5 ml of a 10% aqueous solution of sodium carbonate are admixed and dissolved by heating at 60°-70° C. for 5 minutes, after which a sufficient quantity of hot water is added to make a total of 100 ml. In this dye bath is dipped 5 g of cotton yarn, which is allowed to stand at 60°-70° C. for 20 minutes, whereby the leuco compound is adsorbed on the cotton yarn. The yarn is taken out from the dye bath, washed with water and immersed in a mixture of 1 ml/l of Asahi Oxy-50 [a trademark of Asahi Chemical Co., Ltd., an iodic acid type oxidant] and 5 ml/l of acetic acid at room temperature for 5 minutes, whereby the leuco compound is oxidized. Thereafter, the yarn is taken out, washed thoroughly with water and dried. The above procedure provides a blue yarn. When the above-prepared dye bath is allowed to stand for 24 hours, there is no formation of a blue oxide film on the bath surface. Thus, even 24 hours after preparation, the dye solution is capable of providing a beautifully dyed yarn without uneven coloration. It should be noticed that in the after treatment of the waste dye solution, neutralizing it to pH 6–7 with 5% sulfuric acid does not give rise to hydrogen sulfide.

Similar results are also obtained when nylon and vinylon yarns are used in place of cotton yarn.

EXAMPLE FOR COMPARISON I 0.3 Gram of Asathio Blue-BB and 5 ml of a 6% aqueous solution of sodium sulfide flakes are admixed and dissolved by heating at 60°–70° C. for 5 minutes, after which a sufficient quantity of hot water is added to make a total of 100 ml. In this dye bath is immersed a cotton yarn which is then treated in the same manner as Example 1 to obtain a blue yarn. In the course of dyeing, a blue oxide film appears on the bath surface to interfere with the production of a beautifully level-dyed yarn. Moreover, in the after treatment of the residual bath liquor, 1.7 g/l of hydrogen sulfide is liberated on unetralization to pH 6–7 with 5% sulfuric acid.

EXAMPLE 2

0.5 Gram of Asathio Brown RN [a trademark of Asahi Chemical Co., Ltd.], 5 ml of a 10% aqueous solution of sodium 2-mercaptoethanesulfonate and 4 ml of a 10% aqueous solution of sodium hydroxide are admixed and dissolved by heating at 80°–90° C. for 5 minutes, followed by addition of hot water to make 100 ml. In this dye bath is immersed 5 g of cotton yarn at 80°–90° C. for 30 minutes, whereby the leuco compound is adsorbed on the cotton yarn. The yarn is then taken out and dipped in a mixture of 0.6 g/l of hydrogen peroxide and 5 ml/l of acetic acid at room temperature for 2 minutes so as to oxidize the leuco compound. The yarn is washed thoroughly with water and dried, whereupon a yellow-brown yarn is obtained. Even when the above-prepared dye solution is allowed to stand for 24 hours, there is no yellowish brown insoluble dyestuff on the bath surface. This means that even after a lapse of 24 hours, the dye bath is still capable of providing a level-dyed attractive yarn. In the after treatment of the residual bath, neutralizing it to pH 6–7 with 5% sulfuric acid did not give rise to hydrogen sulfide.

EXAMPLE 3

0.5 Gram of Asathiosol Brown S-GN [a trademark of Asahi Chemical Co., Ltd.], 5 ml of a 10% aqueous solution of sodium thioglycolate and 2.5 ml of a 10% aqueous solution of sodium carbonate are admixed and dissolved by heating at 80°–90° C. for 5 minutes, after which a sufficient quantity of hot water is added to the solution to make 100 ml. In this dye bath is immersed 5 g of cotton yarn at 80°–90° C. for 30 minutes, whereby the leuco compound is adsorbed on the yarn. The cotton yarn is taken out from the bath and immersed in a mixture of 0.6 g/l of hydrogen peroxide and 10 ml/l of acetic acid at room temperature for 3 minutes, followed by thorough washing with water and drying. The above procedure provides a dyed yarn which is brown with a tinge of yellow. Even when the above-prepared bath is allowed to stand for 12 hours, there is no yellowish brown oxide film on the bath surface. Therefore, the dye bath is able to provide a level-dyed attractive yarn even when used after a lapse of 12 hours. Moreover, in the aftertreatment of the residual dye liquor, neutralizing it to pH 6 to 7 with 5% sulfuric acid does not give rise to hydrogen sulfide.

EXAMPLE 4

Dyed yarns are produced in the same manner as Example 3 except that the dyes, organic mercapto compounds and alkalis indicated below in Table 1 are employed in lieu of these used in Example 3. In Table 1, the concentration of dye is the amount (%) of dye relative to the substrate and the concentrations of organic mercapto compound and alkali are the respective concentrations in the dye bath.

TABLE 1

| Experiment No. | Dye | Dye concentration (%) | Organic mercapto compound | Concentration (g/l) | Alkali | Concentration (g/l) | Hue of dyed yarn | Depth of color A (%) | Depth of color B (%) |
|---|---|---|---|---|---|---|---|---|---|
| 1 | Asathio Pure Blue-6G (C.I. Sulfur Blue-2) | 10 | Sodium 2-mercaptoethanesulfonate | 5 | Sodium carbonate | 2.5 | Brilliant blue | 140 | 175 |
| 2 | Asathio Orange Brown 5R (C.I. Sulfur Brown 52) | 10 | Thioglycolic acid | 5 | Sodium hydroxide | 3 | Orange brown | 105 | 1050 |
| 3 | Asathio Maroon 2R | 10 | Thioglycolic acid | 5 | Sodium hydroxide | 3 | Maroon | 100 | 1000 |
| 4 | Asathio Brown RN (C.I. Sulfur Brown 8) | 10 | Thioglycolic acid | 5 | Sodium hydroxide | 3 | Brown | 100 | 500 |
| 5 | Asathio Dark Bordeaux-R (C.I. Sulfur Red 2) | 10 | S-(3-mercapto-2-hydroxypropyl) thiomethanephosphonic acid | 7 | Potassium hydroxide | 3 | Dark reddish purple | 110 | 550 |
| 6 | Asathio Blue-BB (C.I. Sulfur Blue-7) | 10 | Potassium thioglycolate | 5 | Sodium carbonate | 5 | Blue with a tinge of red | 150 | 125 |
| 7 | Asathio Brilliant Green GO (C.I. Sulfur Green 3) | 10 | Potassium thioglycolate | 5 | Sodium carbonate | 5 | Green | 150 | 650 |
| 8 | Asathio Light Green BG (C.I. Sulfur Blue-15) | 10 | Potassium thioglycolate | 5 | Potassium carbonate | 2.5 | Blue Green | 130 | 650 |

TABLE 1-continued

| Experiment No. | Dye | Dye concentration (%) | Organic mercapto compound | Concentration (g/l) | Alkali | Concentration (g/l) | Hue of dyed yarn | Depth of color A (%) | Depth of color B (%) |
|---|---|---|---|---|---|---|---|---|---|
| 9 | Asathio Brilliant Green 2G (C.I. Sulfur Green 25) | 10 | Potassium 3-mercapto-propionate | 5 | Potassium carbonate | 2.5 | Brilliant green | 120 | 600 |
| 10 | Asathio Red Brown 3B (C.I. Sulfur Red 6) | 8 | 3-(2-Hydroxy-ethoxy)-1-mercapto-propionate | 10 | Sodium carbonate | 3 | Red Brown | 150 | 3000 |
| 11 | Asathio Orange OA (C.I. Sulfur Brown 21) | 5 | Dithiodiglycolic acid | 5 | Potassium hydroxide | 3 | Orange | 100 | 1000 |
| 12 | Kayaku Sulfur Black B (C.I. Sulfur Black 1) | 10 | 1,2-Bis(2'-hydroxy-3'-mercaptopropoxy)-ethane | 10 | Sodium carbonate | 5 | Black | 120 | 1200 |
| 13 | Asathio Yellow GG | 6 | 1,2-Bis(2'-mercaptoethoxy)-ethane | 5 | Potassium carbonate | 5 | Yellow | 100 | 1000 |
| 14 | Asathio Navy Blue-R (C.I. Sulfur Blue-5) | 10 | Trisodium 1,3,5-triazino-2,4,6-trimercaptide | 5 | Potassium carbonate | 2.5 | Blue | 150 | 750 |
| 15 | Asathiosol Orange Brown S-9R (C.I. Solubilized Sulfur Brown 52) | 10 | Dipotassium dithiodi-propionate | 10 | Sodium carbonate | 5 | Orange Brown | 120 | 150 |
| 16 | Asathiosol Black S-BN (C.I. Solubilized Sulfur Black 1) | 15 | 1,2-Bis(4',6'-di-mercapto-1',3',5'-triazinyl-2'-amino)ethane | 5 | Sodium carbonate | 5 | Black | 120 | 600 |
| 17 | Asathiosol Brown S-GN | 10 | Potassium thioglycolate | 5 | Sodium carbonate | 5 | Yellow Brown | 130 | 162 |
| 18 | Kayaku Carbon Black D (C.I. Sulfur Black 76) | 15 | S'-(2-sulfoethyl)-thiuronium | 8 | Potassium carbonate | 4 | Black | 110 | 100 |
| 19 | Kayaku Hydron Blue-LB (C.I. Vat Blue-43) | 10 | Sodium 2-mercaptoethane-sulfonate | 5 | Sodium hydroxide | 3 | Blue | 110 | 100 |
| 20 | Asathio Pure Blue-6G | 10 | 3-Mercapto-propanesulfonic acid | 5 | Potassium hydroxide | 2.5 | Brilliant blue | | |
| 21 | Asathio Pure Blue-6G | 10 | Thiobenzoic acid | 5 | Sodium carbonate | 2.5 | Brilliant blue | | |
| 22 | Asathio Pure Blue-6G | 10 | Sodium thiophenol-4-sulfonate | 5 | Sodium carbonate | 2.5 | Brilliant blue | | |
| 23 | Asathio Orange Brown 5R | 5 | 2-Mercapto-benzothiazole | 5 | Sodium hydroxide | 4 | Orange brown | | |
| 24 | Asathio Yellow Brown 2R (C.I. Sulfur Orange 1) | 5 | 2,4,6-Trimercapto-1,3,5-triazine | 5 | Potassium carbonate | 2.5 | Orange with a tinge of yellow | | |
| 25 | Asathio Yellow Brown 2R | 5 | 2-(3'-Sulfoanilino)-4,6-dimercapto-1,3,5-triazine | 5 | Sodium carbonate | 2.5 | Orange with a tinge of yellow | | |
| 26 | Asathiosol Black S-BN | 15 | Sodium dithiodiglycolate | 10 | Sodium hydroxide | 8 | Black | | |
| 27 | Asathiosol Black S-BN | 15 | S-(2-sulfoethyl)-thiuronium | 10 | Potassium hydroxide | 8 | Black | | |
| 28 | Asathio Blue-BB | 7 | 2-Acetyl-thioethane-sulfonic acid | 5 | Sodium hydroxide | 4 | Blue with a tinge of red | | |
| 29 | Asathio Blue-BB | 7 | Methylxanthogen-acetic acid | 5 | Potassium carbonate | 2.5 | Blue with a tinge of red | | |
| 30 | Asathio Blue-BB | 7 | Bis(2-sulfoethyl) disulfide | 5 | Sodium hydroxide | 4 | Blue with a tinge of red | | |
| 31 | Kayaku Carbon Black D | 15 | S-Ethylxanthogen-ethanesulfonic acid | 5 | Sodium hydroxide | 4 | Black | | |

TABLE 1-continued

| Experiment No. | Dye | Dye concentration (%) | Organic mercapto compound | Concentration (g/l) | Alkali | Concentration (g/l) | Hue of dyed yarn | Depth of color A (%) | Depth of color B (%) |
|---|---|---|---|---|---|---|---|---|---|
| 32 | Kayaku Hydron Blue-LR | 10 | Thioglycolic acid | 5 | Sodium hydroxide | 4 | Blue | | |

Referring to Table 1, the depth-of-color value A is the relative depth of color of the dyed yarn according to this invention as assessed visually against the depth of color of the dyed yarn obtained under the same conditions except for the use of sodium sulfide in place of said organic mercapto compound and alkali, the depth of color of the latter yarn being taken as 100 percent. The depth-of-color value B is the relative depth of color of the dyed yarn according to this invention as assessed visually against the depth of color of the dyed yarn obtained under the same conditions except for the use of sodium hydrosulfide in lieu of said organic mercapto compound, the depth of color of the latter yarn being taken as 100 percent.

EXAMPLE 5

12.5 Grams of Asathio Maroon-2 R [a trademark of Asahi Chemical Co., Ltd.] is mixed well with 15 g of thioglycolic acid and 25 ml of a 30% aqueous solution of sodium hydroxide and dissolved with 100 ml of water at 60°-80° C., followed by addition of a sufficient quantity of hot water to make 1 liter. This solution is put into a test jigger-type dyeing machine and 250 g of cotton Gabardine cloth is dyed at 90° C. for 30 minutes (with rewinding once every 5 minutes). The yarn is washed with water and, then, the oxidizing is effected at 40° C. with a mixture of 2 ml/l of 30% hydrogen peroxide and 5 ml/l of 98% acetic acid, followed by washing with water and drying. The above procedure provides a maroon colored cloth.

EXAMPLE 6

30 Grams of Asathio Navy Blue-R [a trademark of Asahi Chemical Co., Ltd.; C.I. Sulfur Blue-5] is kneaded well with 7.5 g of sodium carbonate and 50 g of hot water. Then, 15 g of 1,3-bis(2-hydroxy-3-mercaptopropoxy)-2-propanol is added and the dye is dissolved at 60° C., followed by addition of a sufficient quantity of water to make 1 liter. The temperature of this dye solution is 20° to 40° C. The solution is filled into a pad-steam dyeing machine and at a temperature between 20° and 40° C., a cotton-Tetoron cloth (35:65) is padded, then squeezed 100% and steamed at 102° C. for 30 seconds. The cloth is guided through two aqueous rinse baths and, then, the oxidation is carried out in an oxidation bath (40° C.) comprising a mixture of 2 ml/l of 30% hydrogen peroxide and 5 ml/l of acetic acid. The cloth is further passed through a rinse bath, two baths (60° C.) each comprising a 0.5% aqueous solution of Marseilles soap and an additional aqueous rinse bath, followed by drying in a drying machine. The resultant blue cloth gives the following Hunter values.

$L=14.8, a=3.3, b=-7.9$

EXAMPLE 7

The jigger-dyeing procedure of Example 5 is repeated except that 12.5 g of Asathio Pure Blue-6G [a trademark of Asahi Chemical Co., Ltd.; C.I. Sulfur Blue-2] and 7.5 g of sodium carbonate are used in lieu of Asathio Maroon 2R and aqueous sodium hydroxide solution. The above procedure yields a brilliant-blue cloth.

For comparison purposes, the same jigger-dyeing procedure as above is repeated except that 30 g of crystalline sodium sulfide is used in lieu of thioglycolic acid and sodium carbonate, whereby a brilliant-blue cloth is obtained.

The above two cloths are compared. With the depth of color obtained with sodium sulfide being taken as 100%, the depth of color (by visual assessment) obtained by means of thioglycolic acid and sodium carbonate is 140%. The Hunter values of these dyed cloths are as follows.

| | L | a | b |
|---|---|---|---|
| Comparison | 20.6 | 1.8 | −22.0 |
| Example 7 | 17.5 | 1.9 | −19.3 |

EXAMPLE 8

0.5 Gram of Kayaku Sulfur Black B [a trademark of Nippon Chemical Co., Ltd.; C.I. Sulfur Black 1], 0.5 g of sodium thioglycolate, 0.5 g of sodium carbonate and 10 ml of hot water are admixed well to prepare a solution and a sufficient quantity of hot water is added to make 100 ml. In this solution is immersed 5 g of cotton yarn and the dyeing is carried out at 90° C. for 20 minutes. The dyed yarn is washed with water, oxidized with a mixture of 1 ml/l of Asahi Oxy 50 and 5 ml/l of 98% acetic acid, washed with water and dried. The above procedure provides a black yarn. The depth of color of this yarn is 120% as visually assessed against the depth of color obtained with sodium sulfide.

EXAMPLE 9

The procedure described in Example 8 is repeated except that 0.5 g of Asathio Red Brown 3B [a trademark of Asahi Chemical Co., Ltd.; C.I. Sulfur Red 6] and 0.5 g of thioglycolic acid are used in lieu of Kayaku Sulfur Black B and sodium thioglycolate, respectively, and the dyeing is carried out at a temperature of 60° C. The depth of color of the yarn dyed by the above procedure is 150% as visually assessed against a control yarn dyed with sodium sulfide (100%).

EXAMPLE 10

A beaker is charged with 0.5 g of S-(2-sulfoethyl)thiuronium, 7 ml of a 10% aqueous solution of sodium hydroxide and 5 ml of hot water and the mixture is stirred at 90° C. for 20 minutes to dissolve the dye. In this operation the S-(2-sulfoethyl)thiuronium is transformed to sodium 2-mercaptoethanesulfonate. Then, 0.5 g of Asathio Dark Bordeaux R [a trademark of Asahi Chemical Co., Ltd.; C.I. Sulfur Red 2] is added and dissolved at the same temperature, followed by addition of a sufficient quantity of hot water to make 100 ml. In this solution is immersed 5 g of viscose rayon yarn and the dyeing operation is carried out at 90° C. for 20 minutes. Thereafter, the yarn is worked up in the same manner as Example 1 to obtain a dyed yarn which is dark red brown in color.

EXAMPLE 11

The procedure described in Example 10 is repeated except that 0.5 g of Asathio Vat Olive FG [a trademark of Asahi Chemical Co., Ltd.; C.I. Vat Green 7] is used in lieu of Asathio Dark Bordeaux R. The above procedure provides a dyed yarn which is of olive color.

EXAMPLE 12

0.5 Gram of Asathio Blue BB [C.I. Sulfur Blue-7], 5 ml of a 10% aqueous solution of sodium hydroxide, 1 ml of a 10% aqueous solution of sodium thioglycolate, 0.5 g of crystalline sodium sulfite and 5 ml of hot water are admixed well and heated at 60°–70° C. for 5 minutes to dissolve the dye, etc., followed by addition of a sufficient quantity of hot water to make 100 ml. In this dye solution is immersed 5 g of cotton yarn and the dyeing is conducted at 90°±2° C. for 30 minutes, whereby the leuco compound is adsorbed on the cotton yarn. The yarn is taken out, washed lightly with water and immersed in a mixture of 1 ml/l of Asahi Oxy 50 and 5 ml/l of acetic acid at room temperature for 5 minutes, whereby the leuco compound is oxidized. The yarn is then washed thoroughly with water and dried. The above procedure provides a blue yarn. Even when the above-prepared dye solution is allowed to stand for 24 hours, there occurs no formation of a bluish insoluble dyestuff on the bath surface. Therefore, this dye bath after 24 hours is still capable of providing a blue level-dyed yarn. In an after-treatment of the residual dye bath liquor, neutralizing it to pH 6–7 with 5% sulfuric acid does not give rise to hydrogen sulfide.

Similar results can be obtained using nylon or vinylon yarn instead of cotton yarn.

EXAMPLE 13

25 Grams of Asathio Pure Blue 6G [a trademark of Asahi Chemical Co., Ltd.], 7.5 g of sodium carbonate, 3 g of 2-mercaptoethanesulfonate, 10 g of sodium nitrite and 1 g of Perex NB [a trademark of Kao Soap Co.; a wetting-penetrating agent] and 150 ml of hot water are admixed and dissolved by heating at 60°–70° C. for 10 minutes, after which a sufficient amount of water is added to make 1 liter. This dye solution (1 l) is charged into a test jigger dyeing machine and 250 g of cotton Gabardine cloth is dyed at 70° C.±2° C. for 30 minutes, the cloth being rewound once every 5 minutes. The cloth is washed with water, oxidized in a mixture of 2 ml/l of hydrogen peroxide and 5 ml/l of acetic acid (98%) at 40° C. for 5 minutes, washed again with water and soaped with a mixture of 5 g/l of Marceille soap and 3 g/l of sodium carbonate at 60° C. for 5 minutes. The cloth is then washed with water and dried. The above procedure provides a level-dyed blue cloth.

The above jigger dyeing procedure is repeated except that 30 g of sodium sulfide flakes (purity 60%) are used in lieu of sodium carbonate, sodium 2-mercaptoethanesulfonate and sodium sulfite.

The Hunter values of the above two dyed cloths are as follows.

| | L | a | b | Depth of color (visual) |
|---|---|---|---|---|
| Sodium sulfide | 20.6 | 1.8 | −22.0 | 100% |
| Sodium sulfite + sodium 2-mercapto-ethanesulfonate | 17.0 | 1.9 | −19.4 | 150% |

EXAMPLE 14

30 Grams of Asathio Maroon 2R, 2.5 g of thioglycolic acid, 10 g of potassium hydroxide, 10 g of sodium nitrite and 100 ml of hot water are admixed well and dissolved by heating at 90° C. for 5 minutes. The solution is then diluted with water to make 1 l. The dye solution thus obtained is charged into the padding cell of a pad-steam dyeing machine, in which cotton broad cloth is padded at 20° to 40° C. The cloth is squeezed 100% and steamed at 102° to 104° C. for 30 seconds. The cloth is then washed with water, oxidized in an oxidizing bath [a mixture of 3 ml/l of 30% hydrogen peroxide and 5 ml/l of 98% acetic acid] at 40° C., washed again with water and dried. By the above procedure is obtained a finished cloth which is maroon in color.

As a control, the above procedure is repeated except that 25 g of sodium sulfide flakes (purity 60%) are used in lieu of thioglycolic acid, potassium hydroxide and sodium sulfite.

The Hunter and other values of the two dyed cloths are as follows.

| | L | a | b | Depth of color (visual) |
|---|---|---|---|---|
| Sodium sulfide | 23.0 | 15.9 | 8.1 | 100% |
| Thioglycolic acid + sodium sulfite | 21.5 | 15.6 | 8.0 | 110% |

EXAMPLE 15

0.5 Gram of Asathio Navy Blue R [C.I. Sulfur Blue 5], 0.1 g of S-(2-sulfoethyl)thiuronium and 5 ml of a 10% aqueous solution of sodium hydroxide are admixed well and dissolved by heating at 90° C. for 10 minutes, whereby the S-(2-sulfoethyl)thiuronium is converted to sodium 2-mercaptoethylsulfonate. To this solution is added a sufficient quantity of hot water to make 100 ml. In this diluted solution is immersed 5 g of viscose rayon yarn and the dyeing is carried out at 90° C. for 20 minutes. Thereafter, the yarn is worked up in the same manner as Example 1 to obtain a dyed yarn which is deep blue in color. The depth of color as visually assessed is 120%, with the depth of color of a sodium sulfide control being taken as 100%.

EXAMPLE 16

The procedure of Example 12 is repeated except that the dyes, sulfites, organic mercapto compounds and alkalis are employed to obtain dyed yarns. The depth-of-color values indicated in Table 2 are those obtained by evaluating the depths of color of the yarns dyed by the method of this invention against the depth of color of the control yarns dyed in the same manner except that sodium sulfide is used in lieu of the organic mercapto compounds, sulfites and alkalis.

TABLE 2

| Experiment No. | Dye | Dye concentration (%) | Sulfite | Concentration (g/l) | Organic mercapto compound | Concentration (g/l) | Alkali | Concentration (g/l) | Hue of dyed yarn | Depth of color |
|---|---|---|---|---|---|---|---|---|---|---|
| 1 | Asathio Blue-BB (C.I. Sulfur Blue-7) | 6 | Sodium sulfite | 4 | Potassium 3-mercaptopropionate | 1 | Sodium hydroxide | 5 | Blue with a tinge of red | 130 |
| 2 | Asathio Blue-BB (C.I. Sulfur Blue-7) | 6 | Potassium hydrogen sulfite | 3 | Potassium 3-mercaptopropionate | 1 | Sodium hydroxide | 6 | Blue with a tinge of red | 130 |
| 3 | Asathio Blue-BB (C.I. Sulfur Blue-7) | 6 | Sodium sulfite | 4 | Thioglycolic acid | 1 | Sodium carbonate | 5 | Blue with a tinge of red | 150 |
| 4 | Asathio Blue-BB (C.I. Sulfur Blue-7) | 6 | Magnesium sulfite | 5 | Sodium 2-mercapto-ethanesulfonate | 1.5 | Potassium carbonate | 4 | Blue with a tinge of red | 120 |
| 5 | Asathio Pure Blue-6G (C.I. Sulfur Blue-2) | 10 | Sodium sulfite | 5 | Sodium 3-mercapto-2-hydroxypropyl-sulfonate | 1.5 | Sodium carbonate | 5 | Brilliant blue | 150 |
| 6 | Asathio Pure Blue-6G (C.I. Sulfur Blue-2) | 10 | Sodium hydrogen sulfite | 5 | Dipotassium dithiodipropionate | 1 | Sodium hydroxide | 6 | Brilliant blue | 130 |
| 7 | Asathio Pure Blue-6G (C.I. Sulfur Blue-2) | 10 | Sodium sulfite | 5 | Trisodium 1,3,5-triazino-2,4,6-trimercaptide | 1.5 | Sodium hydroxide | 5 | Brilliant blue | 100 |
| 8 | Asathio Orange Brown 5R (C.I. Sulfur Brown 52) | 10 | Sodium sulfite | 5 | Sodium thioglycolate | 1 | Sodium hydroxide | 5 | Red brown | 140 |
| 9 | Asathio Maroon 2R (C.I. | 10 | Sodium sulfite | 5 | Sodium thioglycolate | 1 | Sodium hydroxide | 5 | Maroon | 110 |
| 10 | Asathio Brown RN (C.I. Sulfur Brown 8) | 10 | Sodium sulfite | 5 | Sodium thioglycolate | 1 | Sodium hydroxide | 5 | Brown | 110 |
| 11 | Asathiosol Black S-BN (C.I. Solubilized Sulfur Black 1) | 15 | Sodium sulfite | 5 | Sodium thioglycolate | 1 | Sodium hydroxide | 5 | Black | 120 |
| 12 | Asathiosol Orange Brown S-9R (C.I. Solobilized Sulfur Brown 52) | 10 | Sodium sulfite | 5 | Sodium thioglycolate | 1 | Sodium hydroxide | 5 | Red brown | 130 |
| 13 | Asathio Brilliant Green 2G (C.I. Sulfur Green 25) | 10 | Sodium sulfite | 5 | Sodium thioglycolate | 1 | Sodium hydroxide | 5 | Brilliant green | 110 |
| 14 | Kayaku Carbon Black D (C.I. Sulfur Black 6) | 15 | Sodium sulfite | 5 | Sodium thioglycolate | 1 | Sodium hydroxide | 5 | Black | 110 |
| 15 | Kayaku Hydron Blue (C.I. Vat Blue-43) | 10 | Sodium sulfite | 5 | Sodium thioglycolate | 1 | Sodium hydroxide | 5 | Blue | 110 |
| 16 | Asathio Brilliant Green GO (C.I. Sulfur Green 15) | 10 | Potassium sulfite | 2.5 | 1,2-Bis(2'-hydroxy-3'-mercaptopropoxy)-ethane | 0.5 | Sodium carbonate | 5 | Green | 130 |
| 17 | Asathio Light Green BG (C.I. Sulfur Blue-15) | 10 | Sodium sulfite | 5 | 1,2-Bis(4',6'-dimercapto-1',3',5'-triazinyl-2'-amino)ethane | 0.5 | Sodium hydroxide | 7 | Blue green | 120 |
| 18 | Asathio Red Brown 3B (C.I. Sulfur Red 6) | 8 | Sodium sulfite | 5 | S-(4'-sulfophenyl) thiuronium | 1 | Sodium hydroxide | 7 | Red brown | 140 |
| 19 | Asathio | 6 | Sodium | 5 | Sodium | 7 | Sodium | 7 | Orange | 100 |

TABLE 2-continued

| Experiment No. | Dye | Dye concentration (%) | Sulfite | Concentration (g/l) | Organic mercapto compound | Concentration (g/l) | Alkali | Concentration (g/l) | Hue of dyed yarn | Depth of color |
|---|---|---|---|---|---|---|---|---|---|---|
| | Orange OA (C.I. Sulfur Brown 21) | | sulfite | | 4-isothiocyano-benzenesulfonate | | hydroxide | | | |
| 20 | Asathiosol Blue-S RC (C.I. Solubilized Sulfur Blue-7) | 10 | Sodium sulfite | 5 | Methylxanthogen-acetic acid | 1 | Potassium hydroxide | 5 | Blue with a tinge of violet | 140 |
| 21 | Asathio Pure Blue-6G (C.I. Sulfur Blue-2) | 10 | Sodium sulfite | 5 | Sodium 2-ethyl-hexylmercaptide | 2 | Sodium hydroxide | 5 | Brilliant blue | 130 |
| 22 | Asathio Pure Blue-6G (C.I. Sulfur Blue-2) | 10 | Sodium sulfite | 5 | 4-Sulfothiobenzoic acid | 1 | Potassium hydroxide | 5 | Brilliant blue | 120 |
| 23 | Asathio Pure Blue-6G (C.I. Sulfur Blue-2) | 10 | Sodium sulfite | 5 | β-Hydroxy-α-mercaptoethyl-benzene-3-carboxylic acid | 1 | Sodium hydroxide | 5 | Brilliant blue | 120 |
| 24 | Asathio Pure Blue-6G (C.I. Sulfur Blue-2) | 10 | Sodium sulfite | 5 | Sodium 1-mercapto-napthalene-6-sulfonate | 1 | Sodium hydroxide | 5 | Brilliant blue | 120 |
| 25 | Asathio Pure Blue-6G (C.I. Sulfur Blue-2) | 10 | Sodium sulfite | 5 | Sodium 2-Mercapto-benzothiazole | 1 | Sodium hydroxide | 5 | Brilliant blue | 120 |
| 26 | Asathio Pure Blue-6G (C.I. Sulfur Blue-2) | 10 | Sodium sulfite | 5 | 2,4-Dihydroxy-6-mercapto-1,3,5-triazine | 1 | Sodium hydroxide | 5 | Brilliant blue | 100 |
| 27 | Asathio Pure Blue-6G (C.I. Sulfur Blue-2) | 10 | Sodium sulfite | 5 | Sodium S-(3-mercapto-2-hydroxy-propyl)-2-thio-ethane-1-sulfonate | 1 | Sodium hydroxide | 5 | Brilliant blue | 110 |
| 28 | Asathio Pure Blue-6G C.I. Sulfur Blue-2) | 10 | Sodium sulfite | 5 | 3-(2-Hydroxy-ethoxy)-1-mercapto-2-propanol | 1 | Sodium hydroxide | 5 | Brilliant blue | 120 |
| 29 | Asathio Pure Blue-6G (C.I. Sulfur Blue-2) | 10 | Sodium sulfite | 5 | 2-Mercaptobenzoic acid | 1 | Sodium hydroxide | 5 | Brilliant blue | 120 |
| 30 | Asathio Pure Blue-6G (C.I. Sulfur Blue-2) | 10 | Sodium sulfite | 5 | 3-Mercapto-1,2-dihydroxypropane | 1 | Sodium hydroxide | 5 | Brilliant blue | 130 |
| 31 | Asathio Orange Brown 5R (C.I. Sulfur Brown 52) | 10 | Sodium sulfite | 5 | Sodium benzylmerpactide | 1 | Sodium hydroxide | 5 | Red brown | 120 |
| 32 | Asathio Orange Brown 5R (C.I. Sulfur Brown 52) | 10 | Sodium sulfite | 5 | Sodium 2,5-dimercaptobenzene-1-sulfonate | 1 | Sodium hydroxide | 5 | Red brown | 120 |
| 33 | Asathio Orange Brown 5R (C.I. Sulfur Brown 52) | 10 | Sodium sulfite | 5 | 1,3-Bis(2'-hydroxy-3'-mercaptopropoxy)-2-propanol | 1 | Sodium hydroxide | 5 | Red brown | 130 |
| 34 | Asathio Orange Brown 5R (C.I. Sulfur Brown 52) | 10 | Sodium sulfite | 5 | 1,2-Bis(2'-hydroxy-3'-mercaptopropyl-amino)ethane | 1 | Sodium hydroxide | 5 | Red brown | 130 |
| 35 | Asathio Orange Brown 5R (C.I. Sulfur Brown 52) | 10 | Sodium sulfite | 5 | 1,3-Dimercapto-2-propanol | 1 | Sodium hydroxide | 5 | Red brown | 140 |
| 36 | Asathio Orange Brown 5R (C.I. Sulfur Brown 52) | 10 | Sodium sulfite | 5 | 1-(4'-Hydroxy-6'-mercapto-1',3',5'-triazinyl-2'-amino)-2-(4'', 6''-dimercapto-1'',3'',5''-triazinyl-2''-amino)ethane | 1 | Sodium hydroxide | 5 | Red brown | 100 |
| 37 | Asathio Orange | 10 | Sodium | 5 | 1,2-Bis(4',6'- | 1 | Sodium | 5 | Red | 100 |

TABLE 2-continued

| Experiment No. | Dye | Dye concentration (%) | Sulfite | Concentration (g/l) | Organic mercapto compound | Concentration (g/l) | Alkali | Concentration (g/l) | Hue of dyed yarn | Depth of color |
|---|---|---|---|---|---|---|---|---|---|---|
| | Brown 5R (C.I. Sulfur Brown 52) | | sulfite | | dimercapto-1',3',5'-triazinyl-2'-amino)ethane | | hydroxide | | brown | |
| 38 | Asathio Orange Brown 5R (C.I. Sulfur Brown 52) | 10 | Sodium sulfite | 5 | S-(2-sulfoethyl)-thiuronium | 1 | Sodium hydroxide | 5 | Red brown | 120 |
| 39 | Asathio Orange Brown 5R (C.I. Sulfur Brown 52) | 10 | Sodium sulfite | 5 | Ethylxanthogen-acetic acid | 2 | Sodium hydroxide | 5 | Red brown | 120 |
| 40 | Asathio Orange Brown 5R (C.I. Sulfur Brown 52) | 10 | Sodium sulfite | 5 | Sodium acethylthio-acetate | 1 | Sodium hydroxide | 5 | Red brown | 120 |
| 41 | Kayaku Black B (C.I. Sulfur Black 1) | 15 | Sodium sulfite | 5 | Sodium 2-acetyl-thioethane sulfonate | 2 | Sodium hydroxide | 5 | Black | 130 |
| 42 | Kayaku Black B (C.I. Sulfur Black 1) | 15 | Sodium sulfite | 5 | Dithiodiethylcarbox-amide | 2 | Sodium hydroxide | 5 | Black | 130 |
| 43 | Kayaku Black B (C.I. Sulfur Black 1) | 15 | Sodium sulfite | 5 | Bis(3-chloro-2-hydroxyprophy) disulfide | 2<br>2 | Sodium hydroxide | 5 | Black | 120 |
| 44 | Kayaku Black B C.I. Sulfur Black 1) | 15 | Sodium sulfite | 5 | Bis(3-sulfo-2 hydroxpropyl) disulfide | 2 | Sodium hydroxide | 5 | Black | 130 |
| 45 | Kayaku Black B (C.I. Sulfur Black 1) | 15 | Sodium sulfite | 5 | Dithiodiethanol | 2 | Sodium hydroxide | 5 | Black | 130 |
| 46 | Asthio Navy Blue-R (C.I. Sulfur Blue-5) | 10 | Sodium sulfite | 5 | Bis(2-mercapto-ethyl)disulfide | 1 | Sodium hydroxide | 5 | Blue | 130 |
| 47 | Asathio Navy Blue-R (C.I. Sulfur Blue-5) | 10 | Sodium sulfite | 5 | Bis[2-(2-hydroxy-ethoxy)ethyl] disulfide | 1 | Sodium hydroxide | 5 | Blue | 130 |

EXAMPLE 17

75 Grams of Kayaku Sulfur Black B (C.I. Sulfur Black 1), 5 g of sodium thioglycolate and 35 g of sodium hydroxide are mixed well in 500 ml of hot water, followed by addition of 10 g of anhydrous sodium sulfite. The solution is diluted with water to make a total of 1000 ml. A pad-steam dyeing machine is charged with the above dye solution and a cotton cloth is padded and steamed. After washing, the cloth is immersed in an oxidizing bath comprising 1 l of a solution containing 5 ml of Asahi Oxy 50 and 5 ml of acetic acid. The cloth is gently washed with water and soaped with 1 l of a solution containing 2 g of Noigen HC and 2 g of sodium carbonate at 90° C. for one minute, followed by drying. The above procedure provides a black cloth. For an accelerated aging test, this cloth is placed in saturated steam at 100° C. for 24 hours. For control purposes, the above dyeing process is repeated except that 50 g/l of sodium sulfide flakes are used in lieu of sodium thioglycolate, sodium hydroxide and anhydrous sodium sulfite. The results are shown below.

| | | Strength of cloth before treatment ($g/cm^2$) | Strength of cloth after treatment ($g/cm^2$) | % Decrease of strength (%) |
|---|---|---|---|---|
| Example 17 | Warp direction | 1227 | 1048 | 14.6 |
| | Filling direction | 2080 | 1606 | 22.8 |
| Comparison | Warp direction | 1178 | 608 | 48.4 |
| | Filling direction | 2048 | 965 | 52.9 |

What is claimed is:

1. In a method of dyeing a textile material wherein the textile material is dyed in an alkaline dye bath using a sulfur dye or sulfurized vat dye, the improvement which comprises the dye bath containing an organic sulfur-containing compound selected from the group consisting of organic mercapto compounds having at least one —$SM_1$ group wherein $M_1$ is a hydrogen atom or an alkali metal atom, organic sulfur compounds capable of generating mercapto groups under dyeing conditions and combinations thereof and a sulfite salt compound wherein said organo sulfur-containing compound is present in a concentration of about 0.1 to about 20 g/l and the concentration of said sulfite salt compound is about 1 to 100 g/l.

2. A dyeing method as set forth in claim 1 wherein said organic sulfur-containing compound is present in a concentration of about 0.2 to 5 g/l.

3. A dyeing method as set forth in claim 1 wherein said sulfite salt compound is a sulfite.

4. A dyeing method as set forth in claim 3 wherein said sulfite is sodium sulfite, potassium sulfite, ammonium sulfite, magnesium sulfite, iron sulfite, copper sulfite, nickel sulfite, zinc sulfite, cobalt sulfite or manganese sulfite.

5. A dyeing method as set forth in claim 4 wherein said sulfite is sodium sulfite or potassium sulfite.

6. A dyeing method as set forth in claim 1 wherein said sulfite salt compound is a hydrogensulfite.

7. A dyeing method as set forth in claim 6 wherein said hydrogensulfite is sodium hydrogensulfite, potassium hydrogensulfite, ammonium hydrogensulfite, magnesium hydrogensulfite, iron hydrogensulfite, copper hydrogensulfite, nickel hydrogensulfite, zinc hydrogensulfite, cobalt hydrogensulfite or magnesium hydrogensulfite.

8. A dyeing method as set forth in claim 7 wherein said hydrogensulfite is sodium hydrogensulfite or potassium hydrogensulfite.

9. A dyeing method as set forth in claim 1 wherein the concentration of said sulfur dye or sulfurized vat dye in the dye bath is about 0.05 to 20% by weight based on the weight of said textile material.

* * * * *